US005441392A

United States Patent [19]

Lundback

[11] Patent Number: 5,441,392

[45] Date of Patent: Aug. 15, 1995

[54] APPARATUS FOR REPETITIVELY DISPENSING A MEASURED VOLUME OF LIQUID

[75] Inventor: Stig Lundbäck, Vaxholm, Sweden

[73] Assignee: Humanteknik AB, Stockholm, Sweden

[21] Appl. No.: 225,510

[22] Filed: Apr. 11, 1994

Related U.S. Application Data

[63] Continuation of Ser. No. 960,435, filed as PCT/SE91/00411, Jun. 7, 1991, abandoned.

[30] Foreign Application Priority Data

Jun. 7, 1990 [SE] Sweden ..... 900205

[51] Int. Cl.[6] ..... F04B 43/02

[52] U.S. Cl. ..... 417/479

[58] Field of Search ..... 417/479, 540

[56] References Cited

U.S. PATENT DOCUMENTS

| | | | |
|---|---|---|---|
| 4,015,914 | 4/1977 | Kushner et al. | 417/479 X |
| 4,236,880 | 12/1980 | Archibald | 417/479 X |
| 4,303,376 | 12/1981 | Siekmann | 417/479 X |
| 4,657,490 | 4/1987 | Abbott | 417/479 X |
| 4,840,542 | 6/1989 | Abbott . | |
| 4,850,817 | 7/1989 | Nason et al. | 417/479 X |

FOREIGN PATENT DOCUMENTS

| | | |
|---|---|---|
| 0374115 | 6/1990 | European Pat. Off. . |
| A8804448-2 | 6/1990 | Sweden . |
| A18701769 | 3/1987 | WIPO . |

*Primary Examiner*—Richard E. Gluck
*Attorney, Agent, or Firm*—Hill, Steadman & Simpson

[57] ABSTRACT

An apparatus for delivering measured liquid volumes comprising a dosing piston pump having an outlet for the measured liquid volumes, and a liquid accumulating device including an accumulator chamber having an inlet for liquid to be dispensed. The accumulator chamber communicates with the pump chamber of the dosing piston pump through a transfer passage having a valve for controlling the transfer of liquid from the accumulator chamber to the pump chamber. The accumulator chamber is expandable to accommodate constantly inflowing liquid through the inlet when the transfer passage is blocked and is contractible as a result of the displacement of a movable wall member so as when the transfer passage is open to transfer accumulated liquid to the dosing piston pump while inflowing liquid flows direct to the dosing piston pump.

25 Claims, 2 Drawing Sheets

APPARATUS FOR REPETITIVELY DISPENSING A MEASURED VOLUME OF LIQUID

This is a continuation of application Ser. No. 07/960,435, filed Dec. 7, 1992, now abandoned.

This invention relates to apparatus for repetitively dispensing av measured volume of liquid and more particularly relates to a dispensing apparatus comprising a dosing piston pump having a dosing pump cylinder and a dosing pump piston which is reciprocable in the dosing pump cylinder and defines together with the dosing pump cylinder a dosing pump chamber having an outlet for the discharge of measured volumes of liquid, and a cylically operating actuating mechanism for positively driving the dosing pump piston at least in the direction corresponding to contraction of the dosing pump chamber.

Dispensing apparatus of this kind have many different applications, and as an illustrative example packaging machines for filling packages with measured volumes or portions of liquid can be taken. The apparatus according to this invention is useful in such packaging machines and accordingly will be described with particular reference to its use as a filling apparatus in a packaging machine. However, the invention is not limited to this application, which is only to be taken as an illustrative example.

Packaging machines for liquid, such as for liquid foodstuffs, e.g., milk or the like, are often required to dispense at high rates an accurately measured volume of liquid while meeting stringent hygienic requirements. In such applications, the volume of the liquid portion to be dispensed to each package and, consequently, the stroke volume of the dosing piston pump, may be quite large.

A rapid dispensing rate coupled with a large volume of the portions means that the dosing piston pump and the conduit system associated with it have to cope with a large volumetric flow rate. Because of the intermittent and rapid discharge of the liquid from the dosing piston pump, the liquid has to be accelerated and retarded quickly every time a discharge takes place.

The stringent requirements on hygiene which have to be met in many cases, such as in machines for packaging liquid foodstuffs, also means a complication. The need to cleanse the surfaces in the dispensing system which are contacted by the product makes it neccessary when designing the dispensing system to take into account the requirements related to the cleansing, and in any case the cleansing requires a substantial effort.

An object of the invention is to provide dispensing apparatus of the kind indicated above and, more particularly, to provide

- a dispensing apparatus to which the liquid to be dispensed can be supplied substantially continuously, although the liquid is discharged discontinuously;
- a dispensing apparatus which can operate at a high rate and with a large portion volume without requiring rapid acceleration and retardation of large masses of liquid for each dispensing cycle;
- a dispensing apparatus which can operate at a high rate while keeping the volume of liquid dispensed in each cycle of operation within close tolerances;
- a dispensing apparatus in which the surfaces contacted by the liquid are provided in a readily and quickly replaceable, preferably sterilisable unit which, if required, can be made sufficiently inexpensive to lend itself, partially or completely, to one-way use, so that it will be economically feasible to discard the entire unit, or parts thereof, and substitute it for a new one in situations in which cleansing of the surfaces would otherwise be neccessary, and so that the packaging machine need not be shut down for cleansing of the dispensing apparatus;
- a dispensing apparatus in which the passages through which the liquid flows to the dosing piston pump can be made with a large cross-sectional flow area and a short length so that the the filling of the dosing pump chamber can take place rapidly and at low loss of pressure, that is, at low losses of energy;
- a dispensing apparatus in which energy of the continuously inflowing liquid can be stored during the phase of the cycle of operation in which the inflow passage of the dosing piston pump is blocked, that is, during the dispensing phase, and then utilized to contribute to the filling of the dosing piston pump when the inflow passage thereof is again opened;
- a dispensing device which is capable of operating at an arbitrary and varying filling pressure, e.g. between 0.5 and 2.5 bars, and also capable of meeting heavy demands in respect of rate of operation, portion volume, and accuracy of the dispensed volume;
- a dispensing apparatus which can be made compact but yet provides ready access to its components for service and maintenance.

A dispensing apparatus which meets the above and such other requirements as are often applied to dispensing apparatus of the kind contemplated here is shown diagrammatically and by way of a non-limiting example in the accompanying drawings and is described in more detail below with reference to the drawings.

Figure 1:
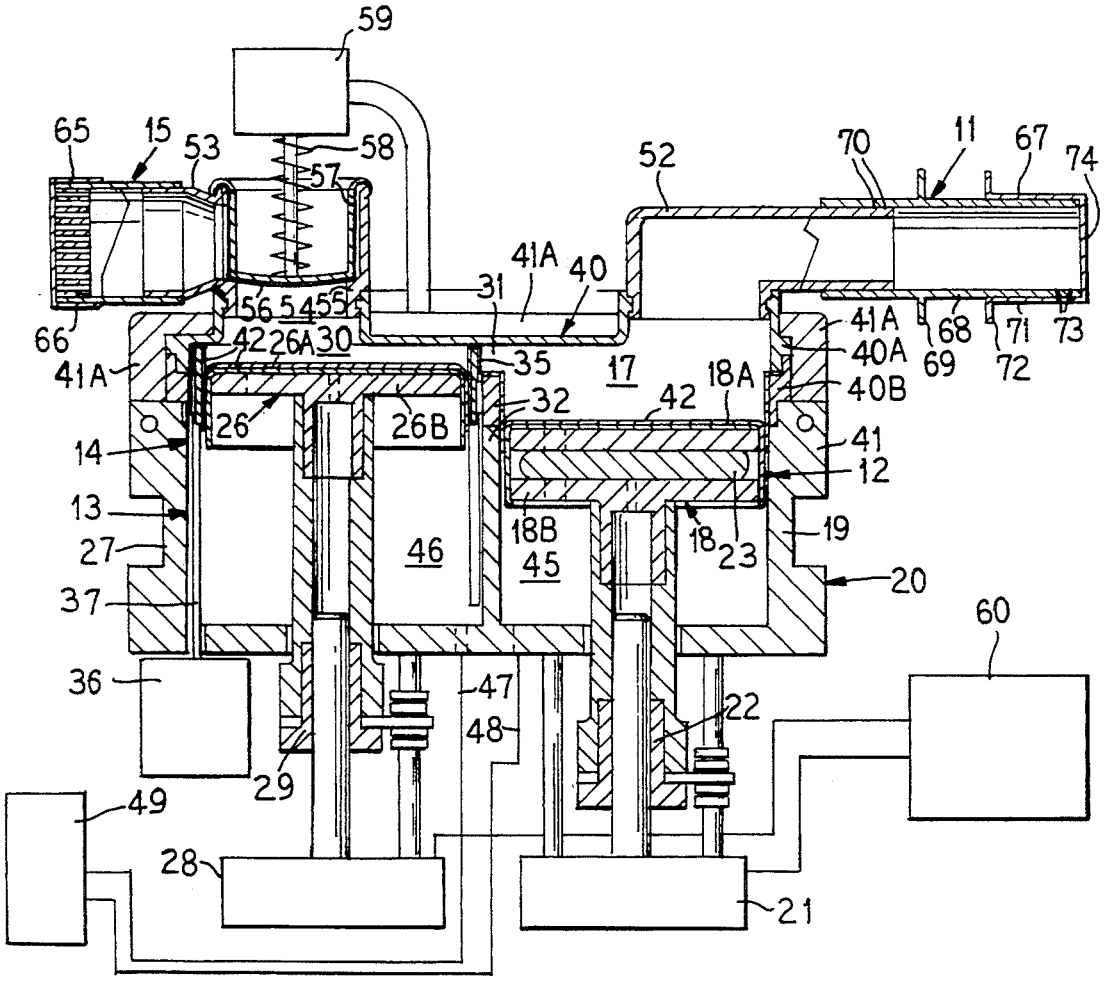
FIG. 1 is a diagrammatic vertical sectional view of the dispensing apparatus.

The dispensing apparatus shown by way of example comprises an inlet tube generally designated by 11 through which the liquid, such as milk or some other liquid food product, is fed to the dispensing apparatus, a feed piston pump generally designated by 12, which is in constant open communication with the inlet tube, a dosing piston pump generally designated by 13, which is in fluid flow communication with the feed piston pump 12, a valve generally designated by 14, which controls the fluid flow communication between the pumps 12 and 13, and an outlet tube, generally designated by 15, through which the metered volumes or portions of liquid are discharged in succession to packages, for example.

The inlet tube 11 is in constantly open communication with the pump chamber 17 of the feed piston pump 12, the communication exhibiting a very low flow resistance. The piston 18 of the pump is movable vertically in a cylinder provided in a pump housing which is common to the two pumps 12 and 13. A driving motor 21, which is shown only as a symbol, drives the piston 18 in the cylinder and to this end is connected with the piston through a ball bearing screw-and-nut mechanism 22.

The piston movement is positive at least in the upward direction, i.e. in the direction in which the piston moves to contract the pump chamber 17. A shock absorbing member 23 provided on the piston absorbs any pressure shocks occurring in the pump chamber 17.

The dosing piston pump 13 is disposed side by side with, and suitably immediately adjacent to, the feed piston pump 12. Its piston 26 is movable vertically in a cylinder 27 which is formed in the pump housing 20 and parallel to the cylinder 19. A driving motor 28 drives the piston in the cylinder 27 through a ball bearing screw-and-nut mechanism 29. The movement of the piston 26 of the dosing piston pump 13 is also positive at least in the upward direction, i.e. the direction which corresponds to contraction of the pump chamber 30.

A horizontal transfer passage 31 provides for the above-mentioned fluid flow communication between the pump chamber 17 of the feed piston pump 12 and the pump chamber 30 of the dosing piston pump 13. This passage is provided at the upper end of the pump cylinders 19 and 27 and formed by removing across the width or diameter of the pump chambers the uppermost portion of the pump housing partition 32 separating the pump chambers 17 and 30. Accordingly, the transfer passage 31 has a width, as measured horizontally and perpendicularly to the plane of FIG. 1, which is at least as large as the diameter of the pump chambers 17 and 30. As measured vertically, the dimension of the transfer passage is substantially smaller, but because of the large width of the passage, its cross-section flow area nevertheless is very large, for example, 15 to 40% of the cross-section area of the piston 18 of the feed piston pump 12. As measured horizontally and parallel to the plane of FIG. 1, the length of the transfer passage varies from a minimum at the vertical plane (the plane of FIG. 1) which contains the parallel axes of the two pumps to a maximum on either side of this plane and at some distance from the plane.

The valve 14, which controls the transfer of the liquid through the passage 31 from the feed piston pump 12 to the dosing piston pump 13, includes a valve member 35 in the shape of a circular cylindrical sleeve which surrounds the pump piston 26 concentrically and is axially displaceable between a closed position and an open position by means of a two-position valve actuating device comprising three solenoids 36. These solenoids are uniformly spaced circumferentially about the pump piston 26 and act on the lower edge of the valve member 35 through the intermediary of respective push rods 37.

In the closed position, the upper edge of the valve member 35 sealingly engages the underside of a top pump housing part 40 which forms the pump housing 20 together with a bottom pump housing part 41. In the open position the upper edge of the valve member 35 is flush with or positioned slightly below the upper side of the partition 32 separating the pump chambers, so that the transfer passage 31 is then open throughout the cross-section flow area.

A thin, very flexible membrane 42, such as a film of polyurethane, provides a seal between the two pump pistons 18 and 26, on the one hand, and the cylinders 19 and 27, on the other hand. Throughout its outer edge the membrane 42 is sealingly clamped between a top section 40A and a bottom section 40B of the top pump housing part 40, and it overlies the upper edge of the valve member 35, the upper side of the partition 32 and the upper sides of the two pump pistons 18 and 26. The upper side of each of the pump pistons 18 and 26 is formed by an inverted cup-shaped piston cap 18A and 26A, respectively, which is loosely positioned over a piston head 18B, 26B.

In the gap between the pump housing 20 and the piston 18 of the feed piston pump 12, in the gap between the pump housing 20 and the valve member 35, and in the gap between the valve member 35 and the piston 26 of the dosing piston pump 13, the membrane 42 hangs down to form a rolling membrane which seals between the elements which move relative to one another.

The compartments 45 and 46 between the bottom pump housing part 41 and the underside of the pump pistons 18 and 26, respectively, are sealed with respect to the surrounding space. Through flexible conduits 47 and 48 they are connected to a pneumatic pressure control device 49 by means of which the compartments can be subjected to a controlled reduced or elevated pressure at predetermined points in the operating cycles of the pumps.

Upwardly, the pump chambers 17 and 32 are defined by the top section 40A of the top pump housing part 40. The portion of the top section 40A which is situated above the pump chamber 17 is provided with a connector 52 for the inlet tube 11. Correspondingly, the portion of the top section 40A which is situated above the pump chamber 30 is provided with a connector 53 for the outlet tube 15.

In the outlet tube 15, namely, in the inlet portion thereof, which cooperates with the connector 53 and is open towards the pump chamber 30, there is provided a valve seat 55 which faces away from the pump chamber. A membrane 56 attached to the connector 53 can be pressed against this valve seat by means of an associated valve member 57 to close off the outlet tube 15. A relatively weak compression spring 58 constantly urges the valve member 57 towards the closed position. However, the closing force on the valve member 57 can be increasead substantially by means of a solenoid 59.

A control unit 60 associated with the dispensing apparatus controls the pump motors 21 and 28 to cause them to move at a selected frequency and with a selected time-travel characteristic. The control unit 60 continuously senses the position of the pump pistons 18 and 26 by means of motion transducers (not shown) which are connected to the pump pistons. The control unit 60 also controls the solenoids 36 for the valve member 35 in the transfer passage 31, the solenoid 59 for the outlet valve member 57, and the pressure control device 49. Accordingly, the operating cycle of the dispensing apparatus is controlled by the control unit 60, which also includes a selector for setting the dosage or portion volume, weight transducers for measuring the weight of the dispensed portions, etc.

A pump or operating cycle of the illustrated dispensing apparatus passes off as follows.

The entire flow path for the liquid which the dispensing device transports and dispenses—this path, which extends through the dispensing apparatus, includes the inlet tube 11, the pump chamber 17 of the feed piston pump 12, the transfer passage 31, the pump chamber 30 of the dosing piston pump 13 and finally the outlet tube 15—is assumed to be filled with liquid, and it is also assumed that the pump has just completed dispensing a liquid portion through the outlet tube 15.

In the thus assumed initial or starting position, the valve member 57 in the outlet tube 15 has just closed against the valve seat 55 under the action of the spring 58 after the piston 26 of the dosing piston pump has reached its uppermost position. The annular cylindrical valve member 35, namely the upper edge thereof, sealingly engages the top section 40A of the top pump housing part 40 through the intermediary of the intervening membrane 42 and thereby blocks the transfer passage 31 to prevent flow between the pump chambers 17 and 30.

The operating cycle described below is commenced by energizing the solenoid 59 to ensure that the valve member 57 is retained in the closed position even when it is subjected to the pressure existing in the inlet tube. Thereupon the valve member 35 is displaced downwardly to open the transfer passage 31. This movement of the valve member is brought about by the pressure exerted by the liquid on the portion of the membrane 42 which is supported by the valve member. Simultaneously or almost simultaneously, the piston 26 of the dosing piston pump 13 starts moving downwardly to permit filling of the pump chamber 30. The downward movement of the piston 26 can be brought about by the driving motor 28, or at least controlled by this motor, through signals from the control unit 60.

As soon as the valve member 35 has opened, the liquid can flow into the pump chamber 30 without undergoing any appreciable pressure drop; the pressure drop is negligible because of the small length and the large width of the passage. Consequently, the pump chamber 30 can be filled extremely rapidly.

If the liquid supplied to the the dispensing apparatus is under a certain overpressure, as it normally is, the pressure tends to drive the piston 26 downwardly, and the driving motor 28 then actually has to operate as a brake (generator). If required, the downward force on the piston can be counteracted by an overpressure in the compartment 46 beneath the piston so that the load on the motor is reduced. Such an overpressure also can contribute to preventing overloading of the membrane 42 at the folds or rolling membrane portions which hang down between the piston 26 and the surrounding valve member 35 and between the latter and the cylinder 27.

Simultaneously with, or shortly after, the opening of the valve member 31 and the commencement of the downward movement of the piston 26 in the dosing piston pump 13, the driving motor 21 of the feed piston pump 12 starts driving the piston 18 of the feed piston pump upwardly. The piston 18 thereby displaces the liquid already contained in the pump chamber 17, and at the same time liquid can flow more or less direct from the inlet tube 11 into the pump chamber 30 of the dosing piston pump.

During the movement of the pistons 18 and 26, the pressure in the compartments 45 and 46 beneath the pistons is controlled by the control device 49 such that an appropriate pressure differential is maintained between the pump chambers 17 and 30, on the one hand, and the compartments 45 and 46 on the other hand. This pressure differential should ensure that the cylindrical folds of the membrane 42 which form rolling membranes remain tightened and perform a uniform rolling motion without becoming excessively loaded.

While the filling of the pump chamber 30 of the dosing piston pump goes on, the solenoid 59 in cooperation with the relatively weak spring 58 acts to keep the valve member 57 in the outlet tube 15 in the closed position against the action of the pressure of the liquid flowing into the pump chamber 30 so that no liquid can flow out of the pump chamber.

When the pump chamber 30 has been filled, the piston 26 is stopped and the valve member 35 is displaced upwardly to the closed position by the solenoids 36. Because the annular cylindrical valve member, the wall of which may be very thin in relation to its diameter, is acted on symmetrically in the radial direction (horizontally) and is loaded vertically downwardly only over a small annular surface, no great force is required to displace the valve member to the closed position. Moreover, the volume of liquid which the valve member 35 displaces as a consequence of its movement is very small.

The last-mentioned volume can be largely or completely accommodated by the pump chamber 30 if the final phase of the downward movement of the pump piston 26 is suitably matched with the upward displacement of the valve member 35 to the closed position. Consequently, the displacement of the valve member to the closed position can take place without causing any backflow of liquid to the pump chamber 17 of the feed piston pump.

After the valve member 35 has reached the closed position, the driving motor 28 of the dosing piston pump 13 displaces the piston 26 upwardly over a distance which corresponds to the volume to be dispensed for each pump operating cycle. While the liquid is being dispensed, the solenoid 59 is deenergized so that the liquid can be dispensed rapidly without the valve member 57 causing any substantial pressure drop. If required, the pressure differential between the pump chamber 30 and the compartment 46 beneath the piston 26 can be increased during the final phase of the upward movement of the piston, so that "overshooting" movement of the piston caused by the dynamic forces is counteracted.

During the phase of the operating cycle which follows the closing of the transfer passage 31, the liquid continues to flow into the pump chamber 17 of the feed piston pump 12. This is possible because the upward movement of the piston 18 of the feed piston pump 12 is interrupted and the piston is allowed to move downwardly so that the pump chamber 17 can expand and accommodate the inflowing liquid. The downward movement, which is brought about, or at least controlled, by the driving motor 22 on command from the control unit 60, suitably is initiated simultaneously with, or shortly before, the upward displacement of the valve member 31 to the closed position (in practice, the overpressure of the inflowing liquid causes the motor 22 as well to act as a brake or generator during the downward piston movement).

When the piston 18 reaches its predetermined lowermost position, the operating cycle is completed, and the chain of events described above may be repeated.

If the reversal of the direction of movement of the piston 18 is suitably matched with the upward displacement of the valve member 35 to the closed position, the shock absorbing member 23 on the piston 18 prevents the displacement of the valve member from causing pressure shocks in the inlet tube and the supply conduit connected therewith, or at least can provide an efficient damping of such pressure shocks.

As is apparent from the foregoing, the liquid to be dispensed can flow continuously to the dispensing apparatus without being substantially affected in the inlet tube or the supply conduit by the cyclically operating dispensing apparatus. Because the liquid flow from the inlet tube 11 into the pump chamber 30 of the dosing piston pump 13 is virtually free of pressure drop, the dispensing apparatus is also very insensitive to varying pressure of the flow of liquid supplied to the dispensing apparatus. As long as the rate of inflow to the dispensing apparatus is sufficiently large, the dispensing apparatus is thus readily capable of dispensing liquid portions of the predetermined volume at the predetermined rate, even if the pressure on the upstream side of the dispensing apparatus varies in operation of the dispensing apparatus or is different from the intended pressure.

The function of the feed piston pump as a "compliance chamber", that is, a chamber which expands and stores liquid that continues to flow into the dispensing apparatus during thae phase of the operating cycle in which transfer through the transfer passage 30 is not possible, and is then contracted when such transfer becomes possible, need not necessarily be fulfilled by a positively driven piston pump as in the illustrated embodiment.

This function can also be fulfilled by an arrangement whereby the space which in the illustrated embodiment is formed by the pump chamber 17 is expanded under the action of the pressure of the inflowing liquid against the action of a spring bias of a displaceable wall of the chamber, the contraction of the space then taking place because the energy stored in the spring displaces the wall.

The energy stored in the spring during the closed period of the transfer passage 30 effects, when the passage is again opened, a very rapid transfer into the pump chamber 30 of the volume of liquid which has been stored in the pump chamber 17 during the same period. Because the transfer can take place virtually without pressure drop, the spring need not overcome any appreciable liquid pressure, and, besides, the mass that the spring has to accelerate while stored energy is dissipated is quite small; this mass is constituted by, in addition to the movable wall and a portion of the spring, the mass of the liquid stored in the pump chamber 17. There is also no tendency during the transfer to forming a void which has to be filled with liquid from the inlet tube 11. Therefore, the inflowing liquid in the inlet tube need not be accelerated but can continue to flow direct into the pump chamber at the same velocity as before.

In the illustrated embodiment the driving motor 21 and the associated ball bearing screw-and-nut mechanism 22 accordingly can be replaced by a spring arrangement which acts on the piston 18 and continuously urges the piston upwardly. Such a spring arrangement suitably may subject the piston to an upwardly directed force which is substantially independent of the position of the piston over at least the major part of the stroke.

However, the illustrated embodiment including a piston which is positively displaced upwardly may be preferable, because it offers the possibility to arrange for the displacement to take place in accordance with a certain time-travel characteristic under the control by the control unit 60.

The just-described amplifying or booster effect on the filling of the pump chamber 30 can also be accomplished, at least partially, in a modification of the illustrated embodiment comprising a positively displaced piston, namely by adding to the feed piston pump 12 a spring arrangement of the above-described kind. The simplest way to realize this addition is to provide in the shock absorbing member 23 such a resiliency that it can serve as the described spring arrangement. In such case, this spring arrangement and the piston 18 jointly effect the transfer of the stored volume of liquid.

Those elements of the dispensing apparatus which are contacted by the liquid form a disposable unit which is wholly or partly discarded and exchanged for a new one after it has been used for a certain time, such as for a work shift or some other work period after which the packaging machine equipped with the dispensing apparatus would normally have to be cleaned. In the illustrated embodiment, these elements are the inlet tube 11, the outlet tube 15, the connector 52 for the inlet tube, the connector 53 (including the membrane 56) for the outlet tube, the top pump housing part 40 with its top section 40A and bottom section 40B, the membrane 42, the piston caps 18A and 26A and the valve member 35.

The disposable unit may be packaged in sterile condition, and after the package has been opened, the disposable unit is positioned on the bottom pump housing part 41 to which it is clamped by means of quick-connector clamps 41A which are pivotally mounted on the bottom pump housing part. Initially, the solenoid 59 and the valve member 57 are moved to the side and they are then brought to the position shown in FIG. 1 after the disposable unit has been brought into position.

Figure 2:
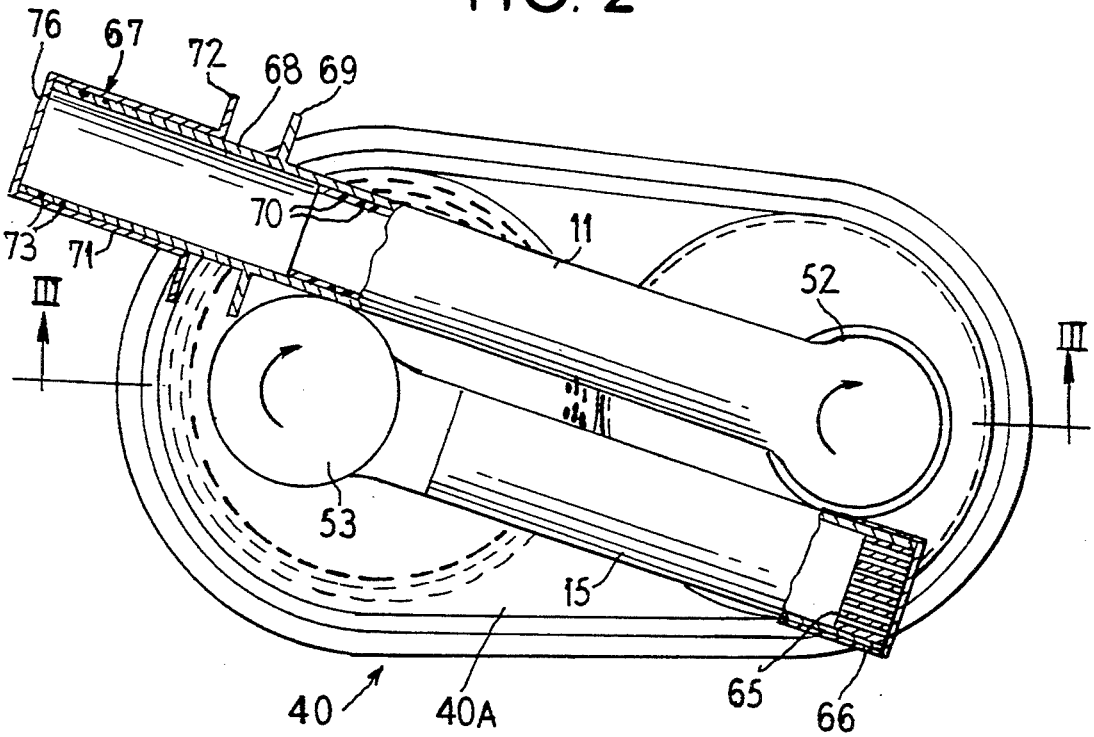
FIG. 2 is a top plan view of a replaceable unit which is partially or wholly adapted for one-way use and forms part of the dispensing apparatus of FIG. 1, the unit being shown in its shipping configuration.
Figure 3:
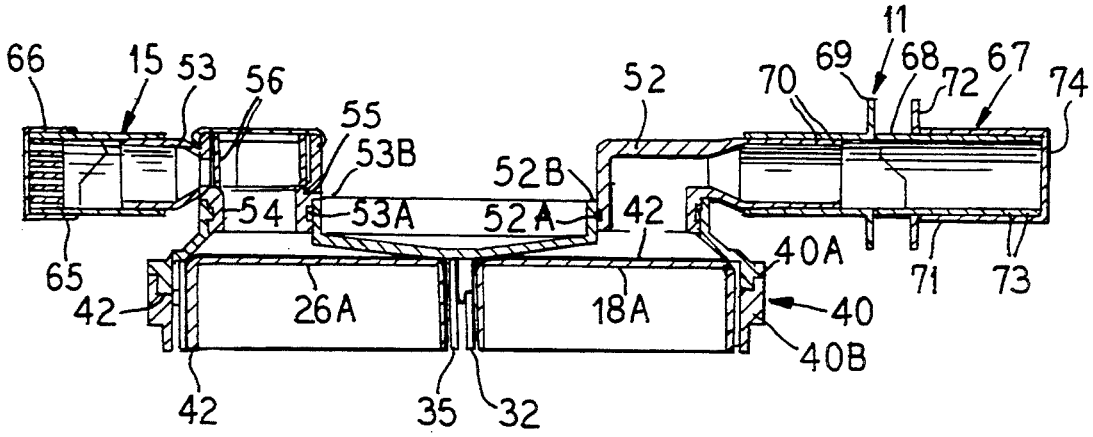
FIG. 3 shows a section of the unit of FIG. 2 along line II—II with an inlet tube and and inlet tube forming parts of the unit swung out to an operating position.

The appearance of the disposable unit in the configuration it has when it is positioned on the bottom pump housing part 41 is shown in FIGS. 2 and 3. The connectors 52 and 53 are rotatably and removably connected with the top section 40A of the top pump housing part through a bayonet coupling 52A, 53A which includes a sealing ring 52B, 53B. In the packaged condition of the disposable unit the connectors are rotated to the position shown in FIG. 2 to save space. From this position they are swung to the operating position (FIGS. 1, 3) after the disposable unit has been positioned on the bottom pump housing part 41.

The membrane 42 is secured to the sections 40A and 40B of the top pump housing part 40 by heat sealing or any other suitable method; the just-mentioned sections are made of plastic and likewise joined through heat sealing.

When the disposable unit is applied to the bottom pump housing part 41, the bottom section 40B of the top pump housing part 40 rests on the upper edge of the circumferentially extending wall of the bottom pump housing part such that it is accurately positioned also laterally (horizontally). The partition 32, which separates the pump chambers 17 and 30 is formed by a top portion belonging to the bottom section 40A of the top pump housing part 40 and a lower portion belonging to the bottom pump housing part 41. The first-mentioned portion of the partition rests against the last-mentioned portion, as shown in FIG. 1. The valve member 35 rests on the push rods 37, and the piston caps 18A and 26A overlie the piston heads 18B and 26B as is also shown in FIG. 1. Moreover, the valve member 47 engages the membrane 56 of the connector 53.

At its outlet end the outlet tube 15 has an insert 65 which is provided with a large number of parallel, through-going passages for the liquid to be dispensed. This insert 65 prevents liquid from flowing out of the outlet tube after the pump piston 26 has reached its uppermost position.

In the sterile package which encloses the disposable unit before it is used, the outlet end of the outlet tube 15, which end is remote from the connector 53, is surrounded by a protective sleeve 66 which serves to preserve the sterility of the interior surfaces of the disposable unit after the package has been opened in connection with the positioning of the disposable unit on the bottom pump housing part 41. When the inlet tube 11 of the disposable unit has been connected to a supply conduit, not shown, associated with the equipment delivering liquid to the dispensing apparatus and operation of the latter is commenced, the protective sleeve 66 will be pushed away from the outlet tube by the pressure therein during the first upward stroke of the pump piston 26.

The end of the inlet tube 11 which is remote from the connector 52, the inlet end, is also provided with a surrounding protective sleeve 67, which preserves the sterility of the interior surfaces of the disposable unit after the package has been opened. Upon the mechanical interconnection of the disposable unit and the supply conduit, the fluid conveying passageway between the disposable unit and the supply conduit is opened in the manner described below.

Mounted exteriorly of the connector 52 is an axially displaceable conduit section 68 provided with a flange 69 at the inner end, that is, the end closest to the top pump housing part 40. Sealing rings 70 seal between the conduit section 68 and the connector 52. The protective sleeve 67 includes a tubular portion 71 which surrounds the outer end of the conduit section 68, and the protective sleeve also has a flange 72 at one end. Sealing rings 73 seal between the inside of the protective sleeve 67 and the outer side of the conduit section 68. A thin membrane 74 forms a fluid tight bottom of the protective sleeve at the end thereof remote from the flange.

To interconnect the disposable unit and the supply conduit, the inlet tube is aligned with the outlet end of the supply conduit, as is indicated in phantom lines in FIG. 1. By means of a mechanism (not shown), which does not form part of the dispensing apparatus, an outwardly directed force is applied to the flange 69 of the conduit section 68 so that the conduit section and the protective sleeve 67 thereon are displaced toward the end of the supply conduit.

The protective sleeve 67 is stopped because its flange 72 engages an abutment while the conduit section 68 is displaced further. The end of the conduit section 68 then ruptures the membrane 74 and is inserted over a certain distance in the supply conduit and seals against the inside of the conduit by means of the sealing rings 73. The membrane 74 may be provided with suitable rupture lines in order that upon the rupturing it may form flaps which fold against the outer side of the conduit section 68. The rupturing of the membrane along predetermined rupture lines may also be ensured if the free end of the conduit section 68 has radial rupture members formed by, for example, an insert provided with cutting edge members.

The arrangement for sterile sealing of the inlet tube 11 shown in the drawings is also useful in other applications where an inlet tube is to be connected with a supply tube while meeting strict requirements for hygiene.

In the illustrated and described embodiment, there is only a single dosing piston pump which is filled from the storage device formed by the feed piston pump. It is also possible, however, to provide the dispensing apparatus with several dosing piston pumps, which are filled through individual transfer passages from a common storage device or feed piston pump in the above-described manner. The dosing piston pumps can then be disposed in different ways in relation to the storage device or feed piston pump, depending on the number of dosing piston pumps and depending on what is suitable in each individual case, having regard to the equipment with which the dispensing apparatus is to be used, such as in a row with the storage device or the feed piston pump positioned to one side of the row, or along a circle or arcuate line.

As is evident from the foregoing description, the described apparatus can also be used as a motor, the energy supplied with the inflowing fluid being then primarily converted to mechanical work and possibly further converted to electrical energy, for example.

I claim:

1. Apparatus for repetitively dispensing measured volumes of liquid, comprising:

a dosing piston pump having a dosing pump cylinder and a dosing pump piston which is reciprocable in the dosing pump cylinder and defines together with the dosing pump cylinder a dosing pump chamber having an outlet for the discharge of metered volumes of liquid, an accumulator device including an accumulator receptacle and a movable wall member which is reciprocable in the accumulator receptacle and defines therewith an accumulator chamber having an inlet for liquid to be received into the accumulator chamber, a transfer passage extending between the dosing pump chamber and the accumulator chamber and having associated therewith a transfer valve for controlling the transfer of liquid from the accumulator chamber to the dosing pump chamber, an actuating mechanism for repetitively and positively driving the dosing pump piston at least in the direction corresponding to contraction of the dosing pump chamber, means for contracting the accumulator chamber by displacing the movable wall member of the accumulator device, and valve means arranged between said outlet and said dosing pump chamber for alternately opening and closing to provide for a pulsed delivery of said metered volumes of liquid.

2. Apparatus according to claim 1, wherein the dosing pump piston, the transfer valve and the movable wall member are adapted for the accumulator receptacle to receive liquid from the inlet substantially continuously throughout a continuous reciprocating operating cycle of the movable wall member.

3. Apparatus according to claim 1, wherein the dosing pump chamber and the accumulator chamber are disposed side by side.

4. Apparatus according to claim 1, wherein the transfer passage is formed in a wall one side of which forms part of the dosing pump cylinder and the other side of which forms part of the accumulator receptacle.

5. Apparatus according to claim 3, wherein the width of the transfer passage as measured perpendicularly to a transfer direction of fluid passing from the accumulator chamber to the dosing pump chamber, the width measured in a direction perpendicular to a direction of movement of the dosing pump piston, is at least approximately equal to a parallel width dimension of the dosing pump piston.

6. Apparatus according to claim 1, wherein the movable wall member comprises a second piston pump, and the accumulator receptacle comprises a pump cylinder, a driving motor being adapted to drive the second piston pump at least in the direction corresponding to contraction of the accumulator chamber.

7. Apparatus according to claim 1, wherein the transfer valve comprise a valve member formed of a cylindrical wall the axis of which substantially coincides with an axis of the dosing pump cylinder and which constitutes at least part of the dosing pump chamber.

8. Apparatus according to claim 7, wherein the transfer valve comprises an actuating device for displacing the valve member to a closed position.

9. Apparatus according to claim 1, further comprising a rolling diaphragm forming a seal between the dosing pump piston and the dosing pump cylinder and between the movable wall member and the accumulator receptacle.

10. Apparatus according to claim 7 further comprising a piece of flexible sheet material and housing portions surrounding the dosing pump chamber and the accumulator chamber, wherein the dosing pump piston, the movable wall member of the accumulator device, the valve member of the transfer valve, and said housing portions are covered by said piece of flexible sheet material.

11. Apparatus according to claim 10, further comprising a top part and a bottom part of a housing containing the dosing pump chamber and the accumulator chamber, and wherein said piece of flexible sheet material forms a unit with said top part of said housing, which unit is replaceably attachable to said bottom part of the housing.

12. Apparatus according to claim 7 further comprising a piece of flexible sheet material and a housing having a top part and a bottom part containing the dosing pump chamber and the accumulator chamber, and wherein the dosing pump piston, the movable wall member of the accumulator device, the valve member of the transfer valve, and the dosing pump chamber and the accumulator chamber are covered by a piece of flexible sheet material, said piece of flexible sheet material forms a unit with a top part of said housing containing the dosing pump chamber and the accumulator chamber, which unit is replaceably attachable to a bottom part of the housing, said unit including the valve member.

13. Apparatus according to claim 12, wherein the valve member is adapted in the closed position thereof to engage the top part through the intermediary of the said piece of flexible sheet material.

14. Apparatus according to claim 11, wherein the inlet and the outlet are provided in the top part.

15. Apparatus according to claim 1 further comprising a fluid pressure chamber on the side of the dosing pump piston remote from the dosing pump chamber is adapted to be subjected to a controllable fluid pressure.

16. Apparatus according to claim 1, further comprising an accumulator fluid pressure chamber on the side of the movable wall member of the accumulator device which is remote from the accumulator chamber and is adapted to be subjected to a controllable fluid pressure.

17. Apparatus according to claim 1, wherein said valve means comprises a valve element which is adapted to be opened under the action of an overpressure in the dosing pump chamber and which is constantly urged towards a closed position by a weak closing force and adapted to be additionally urged towards the closed position by a selectively applicable, substantially greater closing force.

18. Apparatus according to claim 1, wherein the movable wall member of the accumulator device is displaceable for expanding the accumulator chamber against the action of a constantly applied load means for urging the movable wall member in a direction opposite to expanding the accumulator chamber.

19. Apparatus according to claim 1, wherein the accumulator device includes elastic means for accommodating pressure variations in the accumulator chamber.

20. Apparatus according to claim 1, wherein said unit comprises a tube connected to the inlet and having a free end remote from the inlet, which free end is closed by means of a protective device which is openable through relative axial displacement of the protective device and the tube.

21. Apparatus according to claim 1, wherein the transfer valve associated with the transfer passage comprises an actuating device which is operative to close the valve independently of flow in the transfer passage.

22. Apparatus for repetitively dispensing measured volumes of liquid, comprising:

a dosing piston pump having a dosing pump cylinder and a dosing pump piston which is reciprocable in the dosing pump cylinder and defines together with the dosing pump cylinder a dosing pump chamber having an outlet for the discharge of metered volumes of liquid, an accumulator device including an accumulator receptacle and a movable wall member which is reciprocable in the accumulator receptacle and defines therewith an accumulator chamber having an inlet for liquid to be received into the accumulator chamber, a transfer passage extending between the dosing pump chamber and the accumulator chamber and having associated therewith a transfer valve for controlling the transfer of liquid from the accumulator chamber to the dosing pump chamber, an actuating mechanism for repetitively and positively driving the dosing pump piston at least in the direction corresponding to contraction of the dosing pump chamber, means for contracting the accumulator chamber by displacing the movable wall member of the accumulator device, and wherein the transfer valve comprises a valve member formed of a cylindrical wall, the axis of which substantially coincides with an axis of one of the dosing pump cylinder and the accumulator chamber and which constitutes at least part of said one of the dosing pump chamber and the accumulator chamber.

23. An apparatus according to claim 22 further comprising a piece of flexible sheet material and housing portions surrounding the dosing pump chamber and the accumulator chamber, wherein the dosing pump piston, the movable wall member of the accumulator device, the valve member of the transfer valve, and said housing portions are covered by said piece of flexible sheet material.

24. Apparatus according to claim 22, wherein the width of the transfer passage as measured perpendicularly to a transfer direction of fluid passing from the accumulator chamber to the dosing pump chamber, the width measured in a direction perpendicular to a direction of movement of the dosing pump piston, is at least approximately equal to a parallel width dimension of the dosing pump piston.

25. Apparatus according to claim 22, wherein the movable wall member comprises a second piston pump, and the accumulator receptacle comprises a pump cylinder, a driving motor being adapted to drive the second piston pump at least in the direction corresponding to contraction of the accumulator chamber.

* * * * *